US007222611B2

(12) United States Patent
Sekiya et al.

(10) Patent No.: US 7,222,611 B2
(45) Date of Patent: May 29, 2007

(54) FUEL SUPPLY APPARATUS AND FUEL PRESSURE REGULATING METHOD FOR INTERNAL COMBUSTION ENGINE

(75) Inventors: Nobuaki Sekiya, Onna Atsugi (JP); Hiroshi Yamada, Onna Atsugi (JP)

(73) Assignee: Hitachi Ltd., Tokyo (JP)

( * ) Notice: Subject to any disclaimer, the term of this patent is extended or adjusted under 35 U.S.C. 154(b) by 127 days.

(21) Appl. No.: 10/936,803

(22) Filed: Sep. 9, 2004

(65) Prior Publication Data

US 2005/0056258 A1 Mar. 17, 2005

(30) Foreign Application Priority Data

Sep. 12, 2003 (JP) ..... 2003-320622

(51) Int. Cl.
*F02M 37/04* (2006.01)

(52) U.S. Cl. ..... 123/514; 123/456; 123/179.17

(58) Field of Classification Search ..... 123/514, 123/516, 456, 446, 179.17, 506, 457, 458
See application file for complete search history.

(56) References Cited

U.S. PATENT DOCUMENTS 5,398,655 A * 3/1995 Tuckey ..... 123/456
5,598,817 A * 2/1997 Igarashi et al. ..... 123/179.17
5,762,047 A * 6/1998 Yoshioka et al. ..... 123/509
5,842,455 A * 12/1998 Tuckey et al. ..... 123/514
5,878,718 A * 3/1999 Rembold et al. ..... 123/456
6,158,461 A * 12/2000 Frank et al. ..... 137/574
6,792,915 B2 * 9/2004 Rembold et al. ..... 123/446
2002/0092505 A1 * 7/2002 Rembold et al. ..... 123/464

FOREIGN PATENT DOCUMENTS

JP 5-12643 U 2/1993
JP 07-293397 A 11/1995
JP 09-042109 A 2/1997
JP 09-119363 A 5/1997
JP 2002-004965 A 1/2002

* cited by examiner

*Primary Examiner*—Carl S. Miller
(74) *Attorney, Agent, or Firm*—Sughrue Mion, PLLC

(57) ABSTRACT

When an engine operation is stopped, a bypass passage returning fuel in a fuel supply passage into a fuel tank is opened to return a part of the fuel in the fuel supply passage, and a fuel pressure in the fuel supply passage is lowered to a predetermined fuel pressure higher than the atmospheric pressure, to be regulated.

15 Claims, 3 Drawing Sheets

FUEL SUPPLY APPARATUS AND FUEL PRESSURE REGULATING METHOD FOR INTERNAL COMBUSTION ENGINE

FIELD OF THE INVENTION

The present invention relates to a technology for appropriately controlling a pressure in a fuel supply passage at the time when an operation of an internal combustion engine is stopped.

RELATED ART

As a fuel supply apparatus for an internal combustion engine, there has been known a system configured such that, in order to prevent the fuel temperature rise due to excessive fuel, which is not injected to be returned to a fuel tank from a fuel injection valve through a pressure regulator on the downstream of the fuel injection valve, a fuel return passage from the fuel injection valve is eliminated, and a pressure regulator is arranged just after a fuel pump to regulate a fuel pressure (to be referred to as a non-return system).

Japanese Unexamined Patent Publication No. 7-293397 discloses a fuel supply apparatus of such a type, in which in order to prevent that the vapor is generated from fuel remaining in a fuel supply passage after an engine operation is stopped, a residual pressure in the fuel supply passage is held to prevent the vapor generation.

Further, in Japanese Unexamined Utility Model Publication No. 5-12643, a fuel pressure in a fuel supply passage after an engine operation is stopped, is lowered to the atmospheric pressure.

However, in the case where the residual pressure at the time when the engine operation is stopped is held as in Japanese Unexamined Patent Publication No. 7-293397, since the residual pressure is too high, the fuel leakage from the fuel injection valve occurs, so that the fuel vapor tends to be accumulated in a cylinder, resulting in the deterioration of operating performance at the engine re-starting time or the exhaust emission.

Further, if the fuel pressure is lowered to the atmospheric pressure at the time when the engine operation is stopped as in Japanese Unexamined Utility Model Publication No. 5-12643, the vapor tends to be generated, and the engine re-starting performance is degraded due to a delay in the fuel pressure rise at the engine re-starting time.

SUMMARY OF THE INVENTION

The present invention has an object to prevent the fuel leakage from a fuel injection valve and the generation of vapor at the time when an engine operation is stopped.

In order to achieve the above object, the present invention is constituted so that a bypass passage, which returns fuel in a fuel supply passage into a fuel tank, is opened, and a part of the fuel in the fuel supply passage is returned from the opened bypass passage into the fuel tank, and then, a fuel pressure in the fuel supply passage is lowered to a predetermined fuel pressure higher than the atmospheric pressure, to be regulated.

The other objects and features of this invention will become understood from the following description with reference to the accompanying drawings.

DESCRIPTION OF EMBODIMENTS

Figure 1:
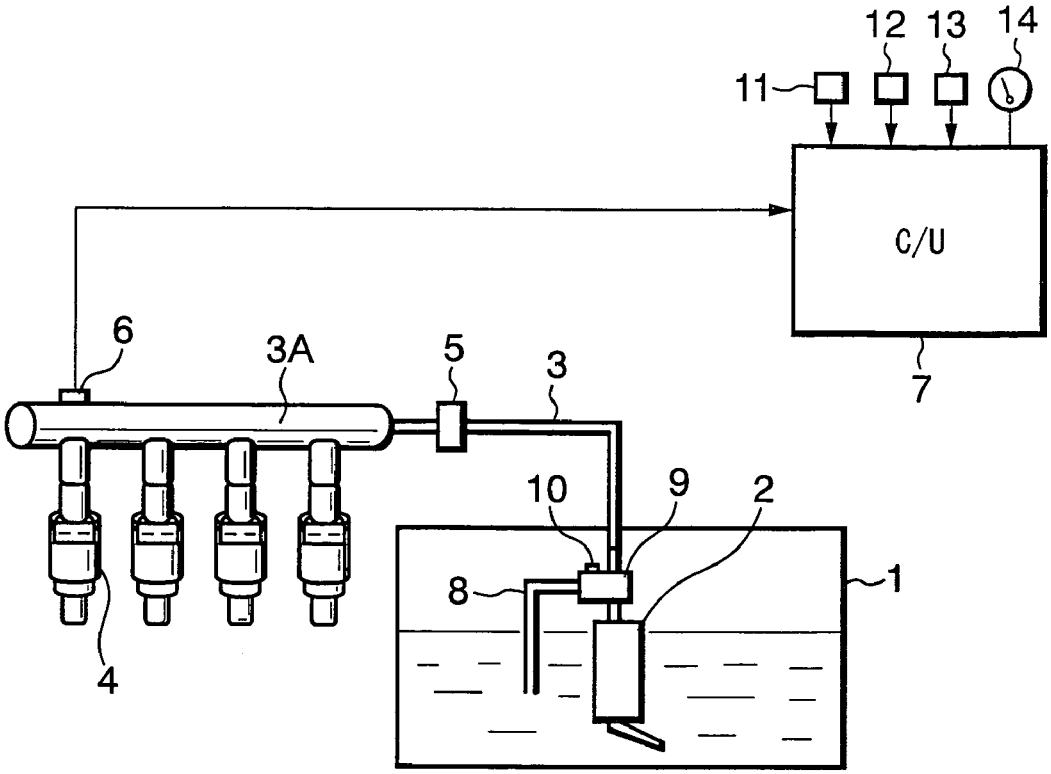
FIG. 1 is a diagram showing a system configuration of an internal combustion engine in a first embodiment.

FIG. 1 is a diagram showing a system configuration of an internal combustion engine in a first embodiment.

In FIG. 1, fuel in a fuel tank 1 is sucked by an electrically operated fuel pump 2, and the fuel discharged from fuel pump 2 is sent under pressure via a fuel supply passage 3 to a fuel injection valve 4 of each cylinder.

A fuel damper 5 is disposed in fuel supply passage 3, and a fuel pressure sensor 6 detecting a fuel pressure is attached to a fuel gallery section 3A on the downstream end.

Fuel injection valve 4 is an electromagnetic fuel injection valve, which is opened when the power is supplied to a solenoid thereof and is closed when the power supply is stopped, and is controlled to open according to a drive pulse signal of predetermined pulse width Ti (valve open time), sent from a control unit 7, corresponding to an engine required fuel quantity, to inject the fuel into an engine intake passage (not shown in the figure).

A bypass passage 8, which bypasses fuel supply passage 3 to return the fuel into fuel tank 1, is connected to the upstream end of fuel supply passage 3, that is, a portion directly above a discharge port of fuel pump 2. On the connection point of bypass passage 8 and fuel supply passage 3, there are disposed an open/close valve 9 switching the communication/the shutoff between fuel supply passage 3 and bypass passage 8, and a pressure regulating mechanism 10 which regulates the fuel pressure in fuel supply passage 3 to a predetermined fuel pressure higher than the atmospheric pressure, when fuel supply passage 3 and bypass passage 8 are communicated with each other by an opening operation by open/close valve 9.

Here, fuel pump 2, bypass passage 8, open/close valve 9 and pressure regulating mechanism 10 are disposed in fuel tank 1.

Figure 2:
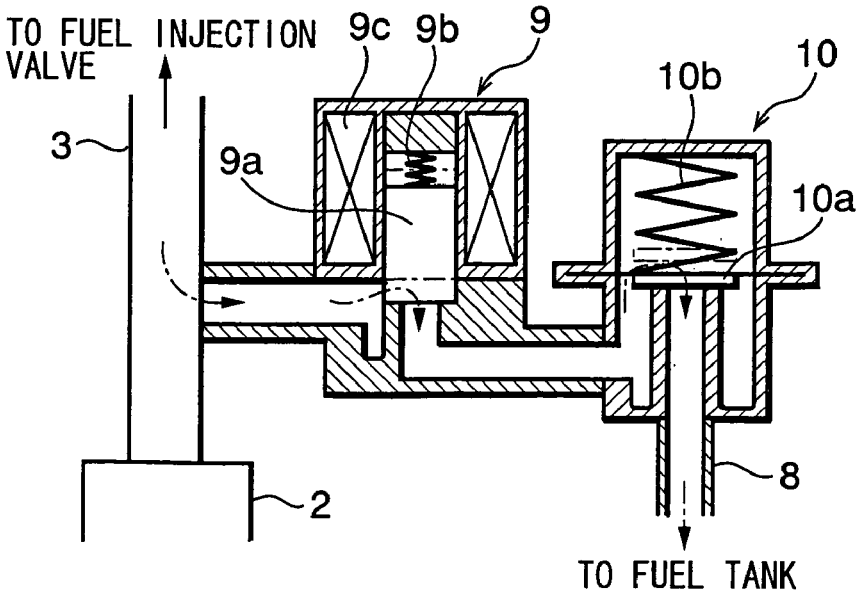
FIG. 2 is an enlarged section view of a pressure regulating mechanism disposed in the first embodiment.

FIG. 2 shows the details of open/close valve 9 and pressure regulating mechanism 10. Open/close valve 9 comprises an electromagnetic valve provided with: a valve body 9*a* opening/closing bypass passage 8 to switch the communication/the shutoff between fuel supply passage 3 and bypass passage 8; a return spring 9*b* urging valve body 9*a* to be closed; and a solenoid 9*c* driving valve body 9*a* to open, and is driven to open/close by an ON/OFF operation of solenoid 9*c* based on a signal from control unit 7. During an engine operation, open/close valve 9 is kept in a closed state by the OFF operation of solenoid 9. Pressure regulating mechanism 10 disposed adjacent to the downstream side of open/close valve 9, comprises: a diaphragm valve 10*a* opening/closing bypass passage 8; and a return spring 10*b* urging diaphragm valve 10*a* to be closed with a predetermined urging force. Here, the urging force of return spring 10*b* is set to be the magnitude at which diaphragm valve 10*a* is opened when it receives a fuel pressure lower than the fuel pressure held in fuel supply passage 3 at the time of the engine operation stop (but higher than the atmospheric pressure).

Control unit 7 receives, in addition to a detection signal from fuel pressure sensor 6, an intake air amount detection signal Q from an air flow meter 11, an engine rotation speed signal Ne from a crank angle sensor 12, an engine cooling water temperature (to be referred as water temperature hereunder) signal Tw from a water temperature sensor 13, an ON or OFF signal from an engine key switch 14, and the like.

Then, in control unit 7 incorporating therein a microcomputer, a basic fuel injection pulse width Tp (basic valve open time) corresponding to the engine required fuel quantity, namely, a cylinder intake air amount, is calculated based on the intake air amount Q and the engine rotation speed Ne, and also, a target fuel pressure Pa of fuel pump 2 is set based on the engine rotation speed Ne and the basic fuel injection pulse width Tp. Thereafter, control unit 7 feedback controls, by a PID control or the like, a basic duty which is set based on the engine rotation speed Ne and the basic fuel injection pulse width Tp, based on the target fuel pressure Pa and the fuel pressure detected by fuel pressure sensor 6, to obtain a control duty signal, and outputs the control duty signal to a pump drive circuit (FPCM) 15 to control fuel pump 2, thereby performing a feedback control to obtain a target fuel pressure.

Thus, the fuel pressure during the engine operation is feedback controlled, and after the engine operation stop, the fuel pressure is regulated, by the control using open/close valve 9 and pressure regulating mechanism 10 according to the present invention.

Namely, when engine key switch 14 is turned OFF, control unit 7 supplies the power to open/close valve 9 for a predetermined period of time, to open it (shown by the chain line in FIG. 2). Then, the fuel pressure held in fuel supply passage 3 at the time of engine operation stop, is applied on diaphragm valve 10*a* of pressure regulating mechanism 10 via open/close valve 9. As described above, the valve opening force acting on diaphragm valve 10*a* by the fuel pressure at the time of engine operation stop is greater than the urging force of return spring 10*b*. Therefore, diaphragm valve 10*a* is urged to open, so that the fuel passes through bypass passage 8 to be returned into fuel tank 1 (shown by the chain-lined arrows in FIG. 2). Thus, when the fuel pressure is lowered so that the valve opening force applied on diaphragm valve 10*a* equals to the urging force of return spring 10*b*, diaphragm valve 10*a* is closed, and the fuel pressure in fuel supply passage 3 communicating with bypass passage 8 on the upstream side of diaphragm valve 10*a* is maintained to be the predetermined fuel pressure which acts, on diaphragm valve 10*a*, a force equal to the urging force of return spring 10*b*. Open/close valve 9 is shut off of the power supply after the predetermined period of time, to be closed, thereby enabling the power consumption to be a minimum while maintaining the fuel pressure to be a predetermined fuel pressure Po.

Figure 3:
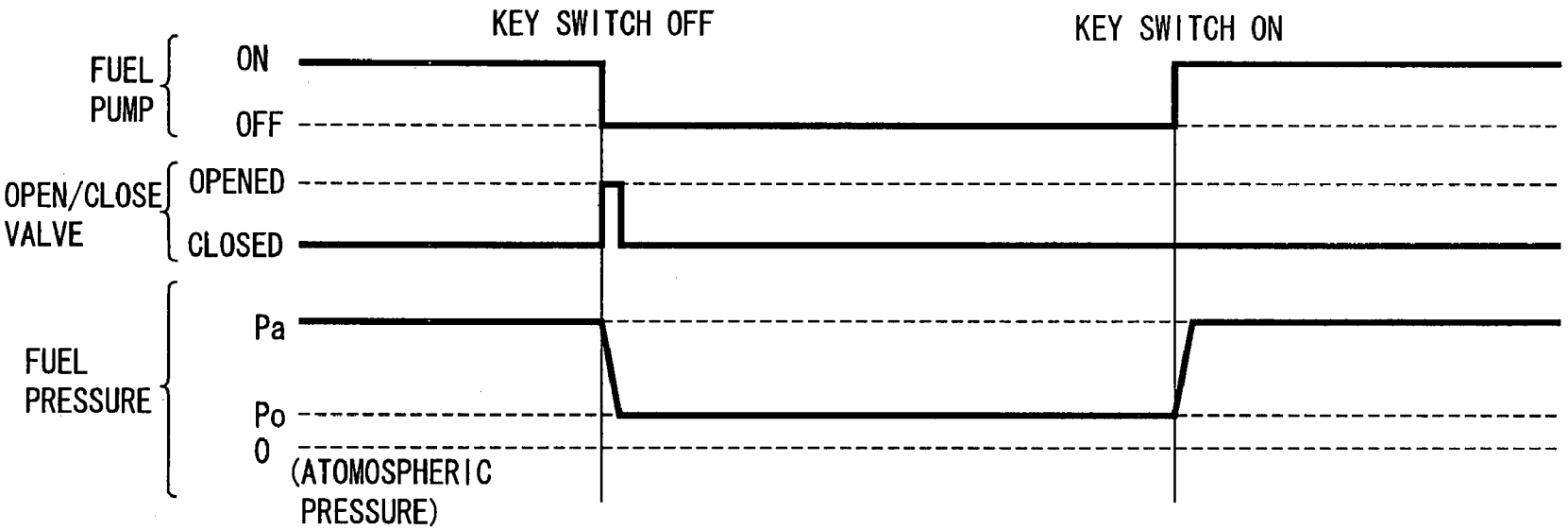
FIG. 3 is a time chart showing states of engine operation stopped time and engine operation re-started time in the first embodiment.

FIG. 3 shows states of engine operation stopped time and engine operation re-started time.

Since the fuel pressure in fuel supply passage 3 is lowered to the predetermined fuel pressure Po after the engine operation stop, it is possible to prevent the fuel leakage from fuel injection valve 4. Further, since the predetermined fuel pressure is higher than the atmospheric pressure, the generation of vapor can be suppressed and also a delay in fuel pressure rise at the engine operation re-started time can be suppressed, thereby satisfying the engine re-starting performance.

Moreover, since fuel pump 2, bypass passage 8, open/close valve 9 and pressure regulating mechanism 10 are disposed in fuel tank 1, a space outside fuel tank 1 can be effectively utilized.

Figure 4:
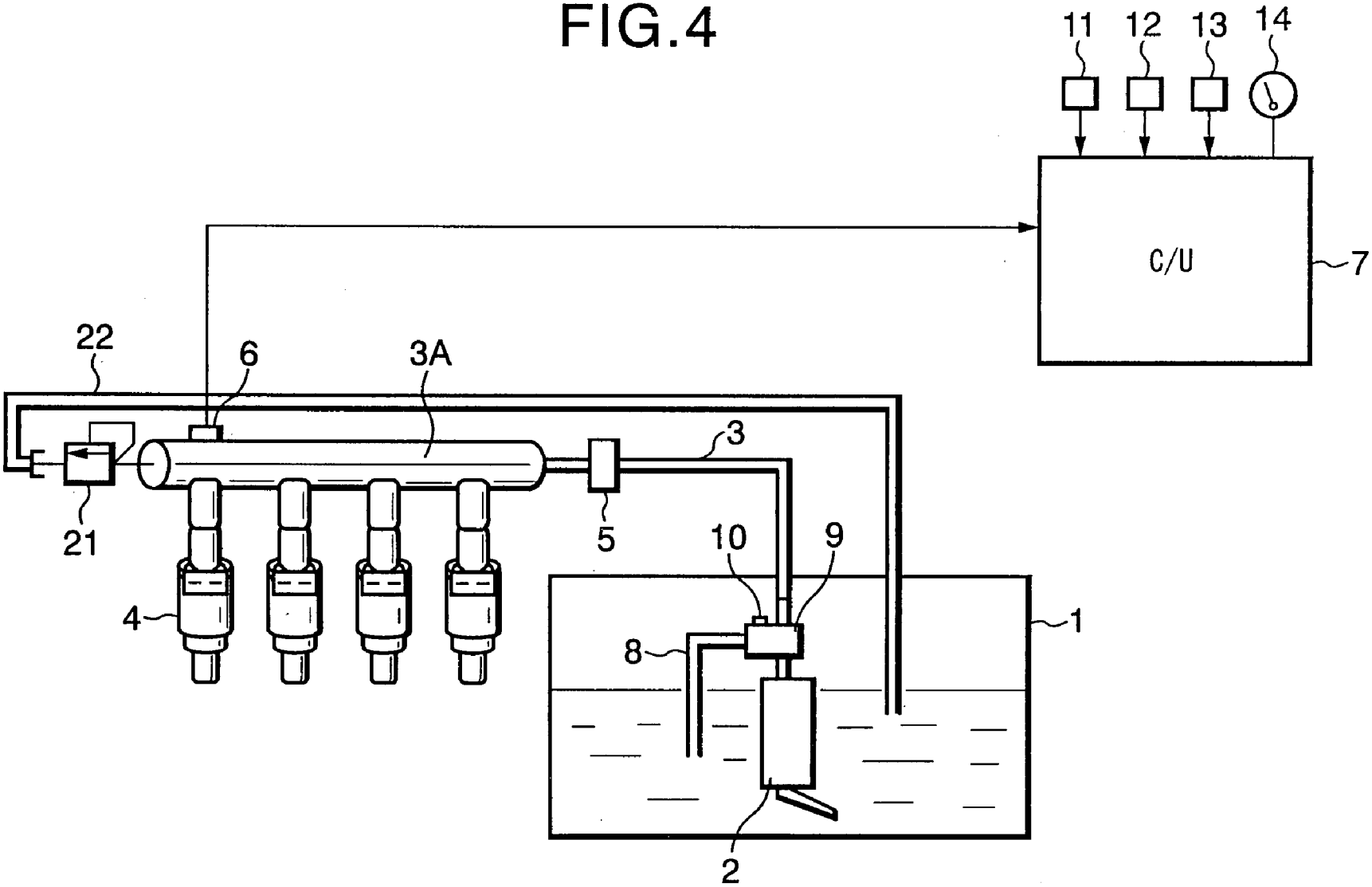
FIG. 4 is a diagram showing a system configuration of a fuel supply apparatus of an internal combustion engine in a second embodiment.

FIG. 4 shows a system configuration in a second embodiment.

In this system configuration, in addition to the configuration in the first embodiment, a relief valve 21 whose open/close operation can be arbitrarily controlled (for example, it is opened when the engine operation is started) and a return passage 22 returning the fuel into fuel tank 1 via relief valve 21 are disposed on the downstream side of a portion, to which fuel injection valve 4 is attached, in fuel supply passage 3.

Thus, even in the case where especially, the fuel temperature becomes high so that the vapor is generated in fuel supply passage 3, relief valve 21 is opened, thereby enabling the vapor to escape to return passage 22.

The entire contents of Japanese Patent Application No. 2003-320622 filed on Sep. 12, 2003, a priority of which is claimed, are incorporated herein by reference.

While only a selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

What is claimed is:

1. A fuel supply apparatus for an internal combustion engine, for supplying fuel in a fuel tank to a fuel injection valve via a fuel supply passage by a fuel pump, comprising:

a bypass passage bypassing said fuel supply passage to return the fuel into said fuel tank;

a communication/shutoff switching mechanism which is capable of switching the communication shutoff between said fuel supply passage and said bypass passage of holding the shutoff between said fuel supply passage and said bypass passage during closed engine operation, and establishes the communication of said fuel supply passage with said bypass passage when engine operation is stopped; and a pressure regulating mechanism which returns a part of the fuel in said fuel supply passage into said fuel tank through said bypass passage to lower a fuel pressure in said fuel supply passage to a predetermined fuel pressure higher than the atmospheric pressure, thereby regulating the fuel pressure, when said fuel supply passage and said bypass passage are communicated with each other by said communication/shutoff switching mechanism.

2. A fuel supply apparatus for an internal combustion engine according to claim 1, wherein said communication/shutoff switching mechanism comprises:

an open/close valve attached to the upstream side of said bypass passage; and a control unit that controls said open/close valve to be opened when the engine operation is stopped.

3. A fuel supply apparatus for an internal combustion engine according to claim 2, wherein said open/close valve is opened when supplied with the power, and is closed when the power supply thereto is stopped, and said control unit supplies the power to said open/close valve for a predetermined period of time, to open said open/close valve, when the engine operation is stopped.

4. A fuel supply apparatus for an internal combustion engine according to claim 1, wherein said pressure regulating mechanism comprises:

a diaphragm valve opening/closing said bypass passage downstream of said open/close valve; and a return spring urging said diaphragm valve to be closed.

5. A fuel supply apparatus for an internal combustion engine according to claim 1, wherein said fuel pump, said bypass passage, an open/close valve of said communication/shutoff switching mechanism, and said pressure regulating mechanism are disposed in said fuel tank.

6. A fuel supply apparatus for an internal combustion engine according to claim 1, wherein a relief valve whose open/close operation can be arbitrarily controlled and a return passage returning the fuel into said fuel tank via said relief valve are disposed on the downstream side of a portion, to which said fuel injection valve is attached, in said fuel supply passage.

7. A fuel supply apparatus for an internal combustion engine according to claim 6, wherein said relief valve is opened when the engine operation is started.

8. A fuel supply apparatus for an internal combustion engine according to claim 1, wherein the fuel pressure in said fuel supply passage is detected, and the fuel pressure detection value is controlled to reach a target fuel pressure set based on engine operating conditions, when the engine is normally operated.

9. A fuel supply apparatus for an internal combustion engine, for supplying fuel in a fuel tank to a fuel injection valve via a fuel supply passage by a fuel pump, comprising:

a bypass passage bypassing said fuel supply passage to return the fuel into said fuel tank;

communication/shutoff switching means capable of switching the communication/the shutoff between said fuel supply passage and said bypass passage and holds the shutoff between said fuel supply passage and said bypass passage during closed engine operation, and establishes communication of said fuel supply passage with said bypass passage when engine operation is stopped; and pressure regulating means for returning a part of the fuel in said fuel supply passage into said fuel tank through said bypass passage to lower a fuel pressure in said fuel supply passage to a predetermined fuel pressure higher than the atmospheric pressure, thereby regulating the fuel pressure, when said fuel supply passage and said bypass passage are communicated with each other by said communication/shutoff switching mechanism.

10. A method of regulating a fuel pressure in a fuel supply passage which supplies fuel discharged from a fuel tank by a fuel pump to a fuel injection valve of an internal combustion engine, having:

a bypass passage arranged to bypass said fuel supply passage for returning the fuel into said fuel tank;

a communication/shutoff switching mechanism which is capable of switching a communication/shutoff between said fuel supply passage and said by bypass passage; and a pressure regulating mechanism arranged in said fuel supply passage for regulating a fuel pressure in said fuel supply passage by permitting a part of the fuel in said fuel supply passage to return into said fuel tank through said bypass passage to thereby lower the fuel pressure in said fuel supply passage to a predetermined fuel pressure higher than the atmospheric pressure when the communication is established between said fuel supply passage and said bypass passage, comprising the steps of:

holding the shutoff between said fuel supply passage and said bypass passage closed during operation of the engine; and regulating a fuel pressure in said fuel supply passage to be lowered to the predetermined fuel pressure higher than the atmospheric pressure by said pressure regulating mechanism when engine operation is stopped by permitting said communication/shutoff switching mechanism to be switched from the shutoff to a communication states between said fuel supply passage and said bypass passage.

11. A method of regulating a fuel pressure in a fuel supply passage according to claim 10, wherein said step of permitting said communication/shutoff mechanism to be switched from the shutoff to the communication includes opening an open/close valve disposed in said bypass passage to open said bypass passage.

12. A method of regulating a fuel pressure in a fuel supply passage according to claim 10, wherein said step of permitting said communication/shutoff mechanism to be switched from the shutoff to the communication includes urging to open an open/close valve which is disposed in said bypass passage, and returning the fuel into said fuel tank until said open/close valve is closed, to lower the fuel pressure to the predetermined fuel pressure.

13. A method of regulating a fuel pressure in a fuel supply passage according to claim 10, further comprising the step of;

returning a part of the fuel into said fuel tank from the downstream side of a portion, to which a fuel injection valve is attached, in said fuel supply passage, when the engine operation is started.

14. A method of regulating a fuel pressure in a fuel supply passage according to claim 13, wherein said step of returning the part of the fuel into said fuel tank when the engine operation is started;

opens a relief valve disposed on the downstream side of the portion, to which said fuel injection valve is attached, in said fuel supply passage, to return the fuel into said fuel tank via a return passage connected to said relief valve.

15. A method of regulating a fuel pressure in a fuel supply passage according to claim 10, further comprising the steps of:

detecting the fuel pressure in said fuel supply passage; and controlling the fuel pressure detection value to reach a target fuel pressure set based on engine operating conditions, when the engine is normally operated.

* * * * *